US006474666B1

(12) United States Patent
Andersen et al.

(10) Patent No.: US 6,474,666 B1
(45) Date of Patent: Nov. 5, 2002

(54) SHOCK ABSORBING SKATE TRUCK ASSEMBLY

(76) Inventors: Scott D. Andersen, 2088 Hidden Valley La., Camino, CA (US) 95709; Ole S. Andersen, 2088 Hidden Valley La., Camino, CA (US) 95709

( * ) Notice: Subject to any disclaimer, the term of this patent is extended or adjusted under 35 U.S.C. 154(b) by 0 days.

(21) Appl. No.: 09/809,954

(22) Filed: Mar. 14, 2001

Related U.S. Application Data

(63) Continuation-in-part of application No. 09/528,527, filed on Mar. 20, 2000.

(51) Int. Cl.[7] ..... A63C 17/92

(52) U.S. Cl. ..... 280/87.041; 280/11.28; 280/87.042

(58) Field of Search ..... 280/87.041, 87.042, 280/11.28, 11.19, 11.27, 11.26, 11.23, 11.204; 301/137, 5.7

(56) References Cited

U.S. PATENT DOCUMENTS

| | | | | | |
|---|---|---|---|---|---|
| 2,330,338 | A | * | 9/1943 | Dekome et al. | 280/11.28 |
| 2,510,722 | A | * | 6/1950 | Snyder | 280/11.28 |
| 2,547,796 | A | * | 4/1951 | Swensson | 280/11.28 |
| 2,560,017 | A | * | 7/1951 | Ware | 280/11.28 |
| 2,578,911 | A | * | 12/1951 | Horn | 280/11.28 |
| 2,606,768 | A | * | 8/1952 | Wagner | 280/11.28 |
| 2,664,295 | A | * | 12/1953 | Horn | 280/11.28 |
| 2,744,759 | A | * | 9/1956 | Sternbergh | 280/11.28 |
| 4,047,725 | A | | 9/1977 | Pinchock | |
| 4,278,264 | A | * | 7/1981 | Lenz | 280/11.28 |
| 4,398,734 | A | | 8/1983 | Barnard | |
| 4,398,735 | A | | 8/1983 | Evans et al. | |
| 4,645,223 | A | | 2/1987 | Grossman | |
| 4,915,399 | A | * | 4/1990 | Marandel | 280/11.28 |
| 5,853,182 | A | | 12/1998 | Finkle | |
| 6,182,987 | B1 | * | 2/2001 | Bryant | 280/87.042 |

FOREIGN PATENT DOCUMENTS

| | | | | |
|---|---|---|---|---|
| FR | 2586619 | * | 9/1985 | 280/11.28 |
| GB | 2066675 | * | 7/1981 | 280/84.041 |

* cited by examiner

*Primary Examiner*—Brian L. Johnson
*Assistant Examiner*—Hau Phan
(74) *Attorney, Agent, or Firm*—Thomas R. Lampe

(57) ABSTRACT

A shock absorbing skate truck assembly includes a resilient shock absorber at the king pin located between the assembly base of the assembly and the axle support member for absorbing shocks encountered during use. Another shock absorber is located in a recess of the assembly base and is engaged by an axle support member arm. The shock absorber in the recess includes a flexible, resilient component and a non-flexible, non-resilient component.

3 Claims, 6 Drawing Sheets

SHOCK ABSORBING SKATE TRUCK ASSEMBLY

This application is a Continuation-in-Part of U.S. application Ser. No. 09/528,527, filed Mar. 20, 2000.

TECHNICAL FIELD

This invention relates to a skate truck assembly for use with skateboards, roller skates and the like and more particularly to a skate truck assembly including structure for absorbing shocks during use.

BACKGROUND OF THE INVENTION

Skate truck assemblies such as those employed on skateboards typically incorporate an axle support member which is positioned about a king pin with two cushions, bushings or resilient pads being employed in cooperation with the axle support member to control and adjust the steering capabilities of the skateboard employing the truck assembly. Other arrangements exist wherein only a single resilient pad, cushion or bushing is employed for such purpose. However, whether such devices are of a single or double resilient pad type, no appreciable shock absorbing function is provided. Furthermore, adjustment of such devices by applying compressive forces to the resilient pad or pads to change the steering characteristics of the truck assembly can also result in undesirable lessening of what little shock absorber action may exist.

The following patents are believed to be representative of the current state of the art in this field: U.S. Pat. No. 4,398,734, issued Aug. 16, 1983, U.S. Pat. No. 5,853,182, issued Dec. 29, 1998, U.S. Pat. No. 4,047,725, issued Sep. 13, 1977, U.S. Pat. No. 4,398,735, issued Aug. 16, 1983, and U.S. Pat. No. 4,645,223, issued Feb. 24, 1987. The patents noted above do not suggest or teach the structural arrangement disclosed and claimed herein which provides a shock absorbency feature in a skateboard truck assembly, the degree of shock absorbency being adjustable without affecting the steering characteristics of the skateboard truck assembly, as well as other features contributing to stability and performance.

DISCLOSURE OF INVENTION

The present invention relates to a shock absorbing skate truck assembly including an assembly base defining an assembly base recess.

A king pin projects from the assembly base and has a threaded distal end. The king pin is spaced from the assembly base recess.

The assembly also includes an axle support member defining an axle support member opening, the king pin projecting through the axle support member opening. The axle support member is movable relative to said king pin and the axle support member includes an axle support member arm having a distal end located at said assembly base recess.

A first shock absorber is positioned between the axle support member and the assembly base at the king pin.

A second shock absorber is located in the assembly base recess engageable by the distal end of the axle support member arm. The second shock absorber includes a resilient, flexible shock absorber element and a non-resilient, non-flexible shock absorber element.

Other features, advantages, and objects of the present invention will become apparent with reference to the following description and accompanying drawings.

MODES FOR CARRYING OUT THE INVENTION

Figure 1:
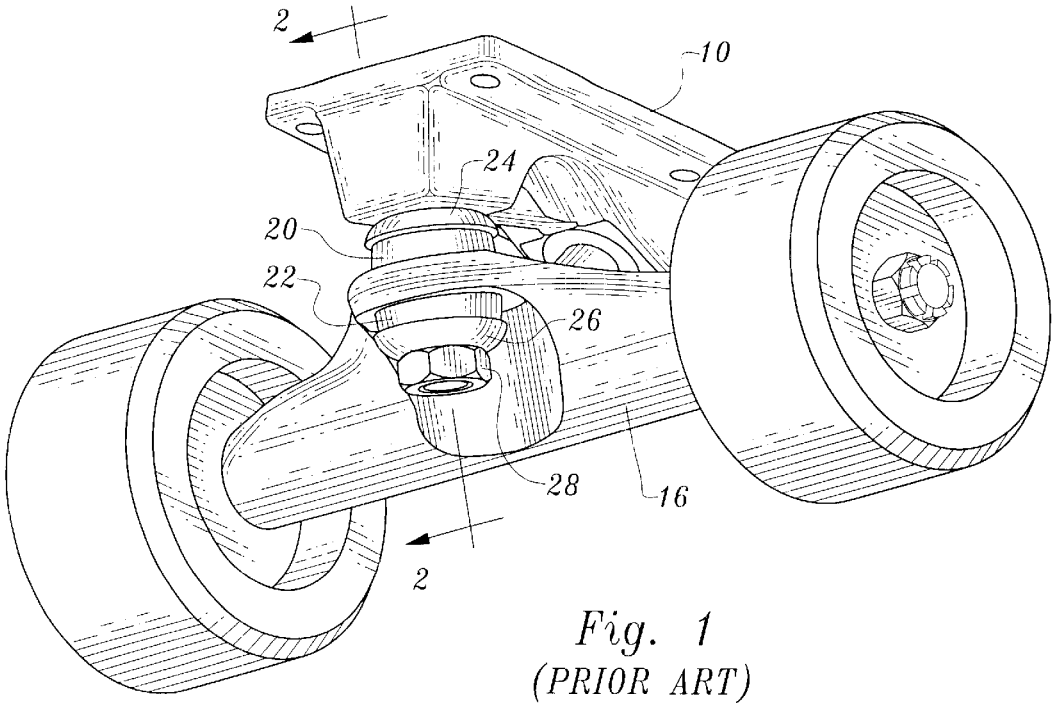
Fig. 1 (PRIOR ART)
FIG. 1 is a perspective view of a typical prior art skateboard truck assembly.
Figure 2:
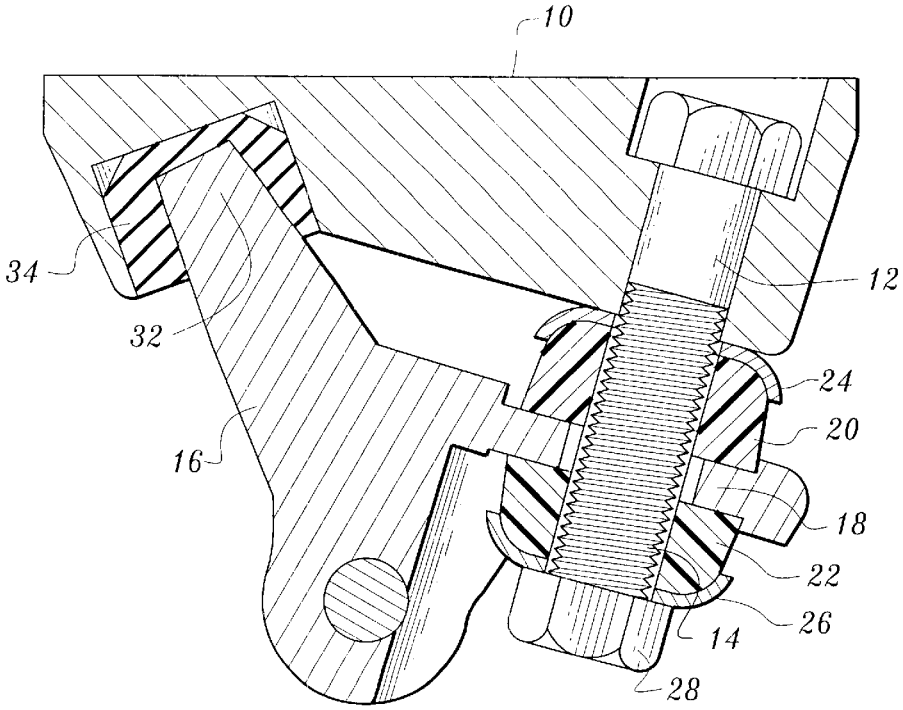
Fig. 2 (PRIOR ART)
FIG. 2 is an enlarged, cross-sectional view taken along line 2—2 in FIG. 1.
Figure 3:
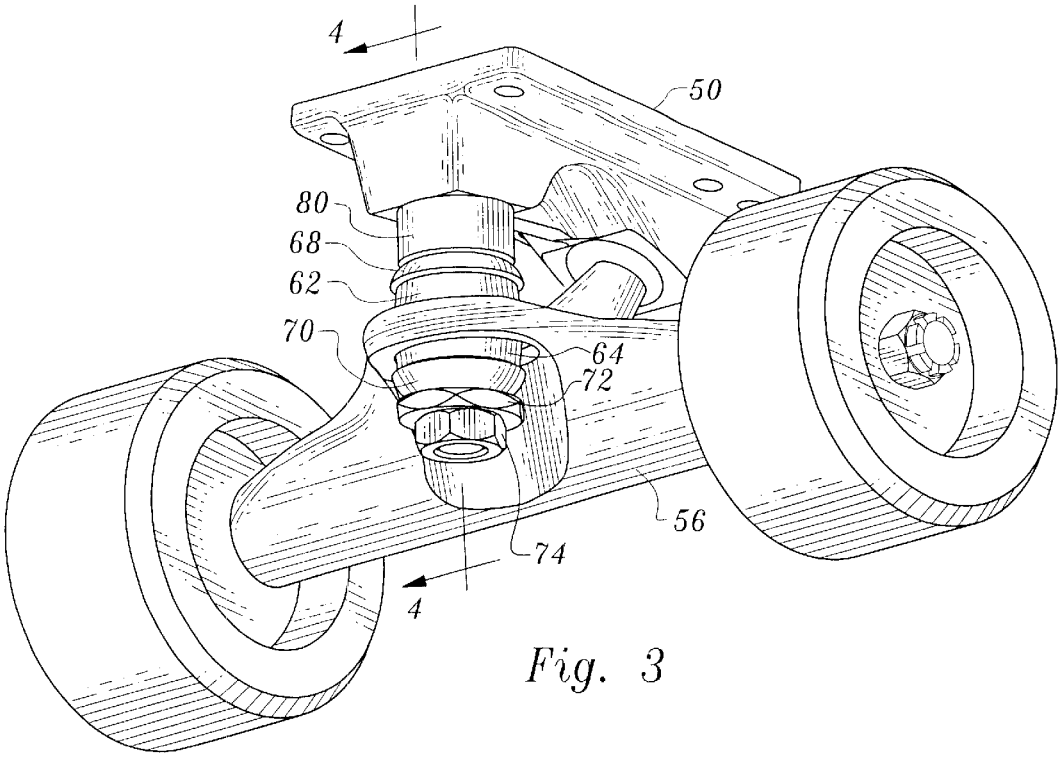
FIG. 3 is a view similar to FIG. 1 but illustrating a shock absorbing skateboard truck assembly constructed in accordance with the teachings of the present invention.
Figure 4:
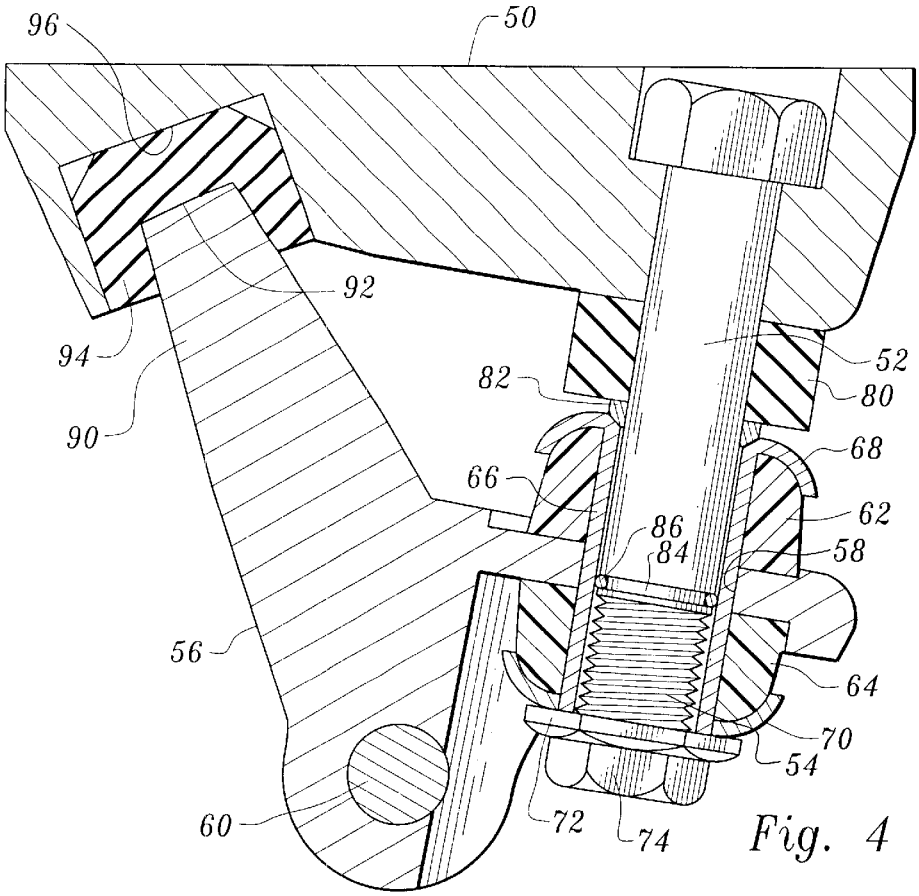
FIG. 4 is an enlarged, cross-sectional view taken along the line 4—4 in FIG. 3.
Figure 5:
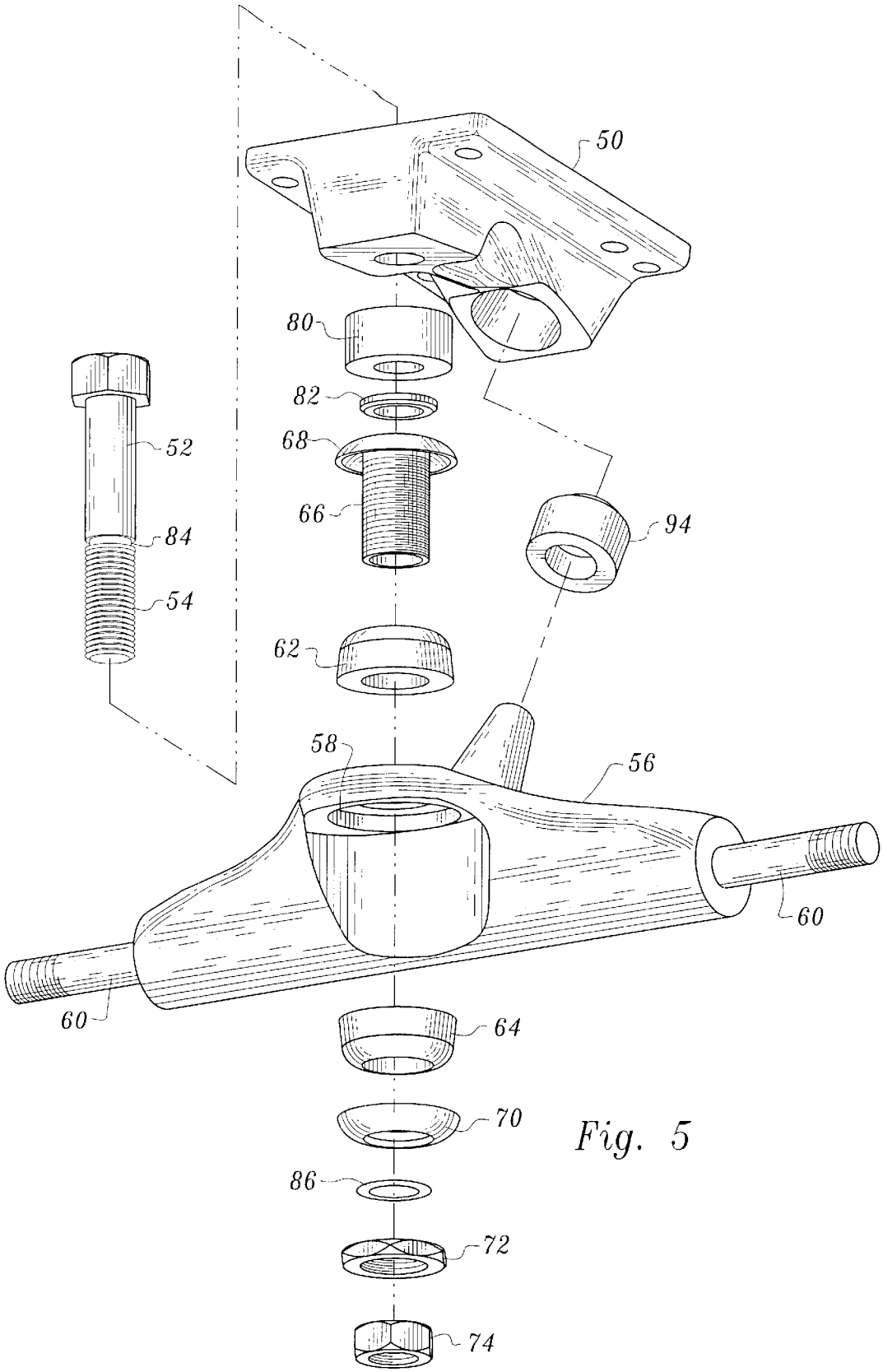
FIG. 5 is an exploded, perspective view illustrating the components of the shock absorbing skateboard truck assembly of FIG. 3.
Figure 6:
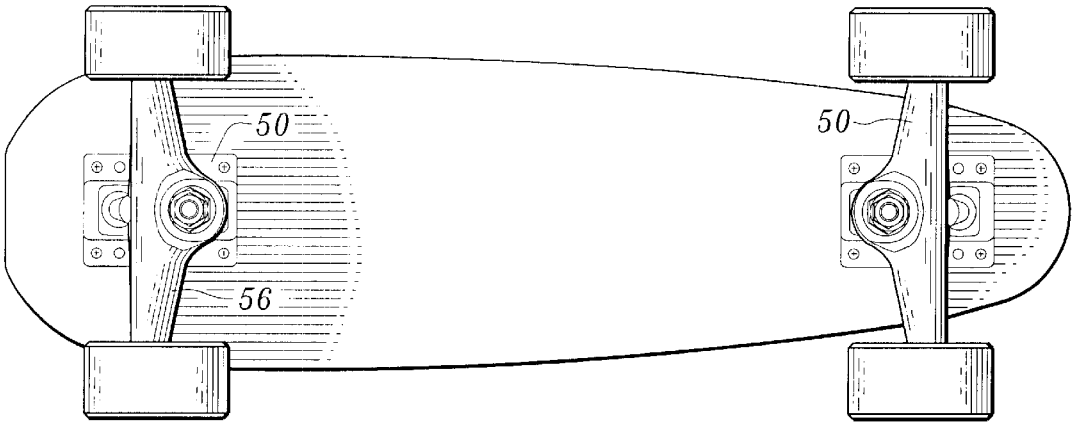
FIG. 6 is a bottom plan view of a skateboard to which are attached two shock absorbing skateboard truck assemblies of the type shown in FIG. 3.
Figure 7:
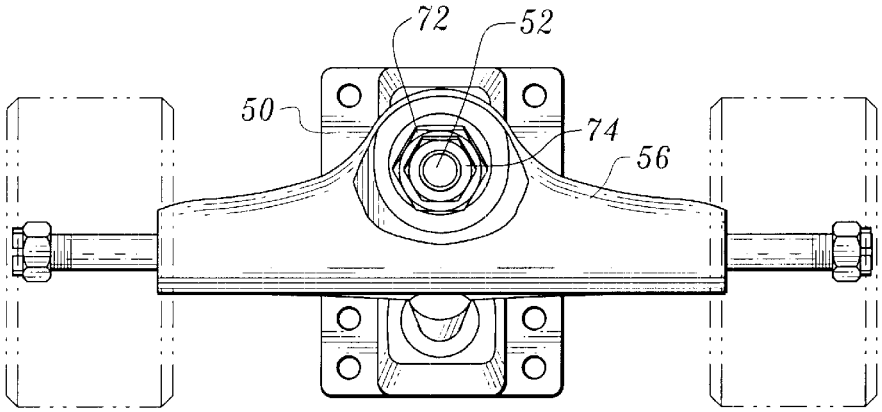
FIGS. 7 and 8 are enlarged, bottom plan views of the shock absorbing skateboard truck assembly, wheels shown in phantom, with FIG. 8 illustrating a typical configuration of the assembly components when making a turn.
Figure 8:
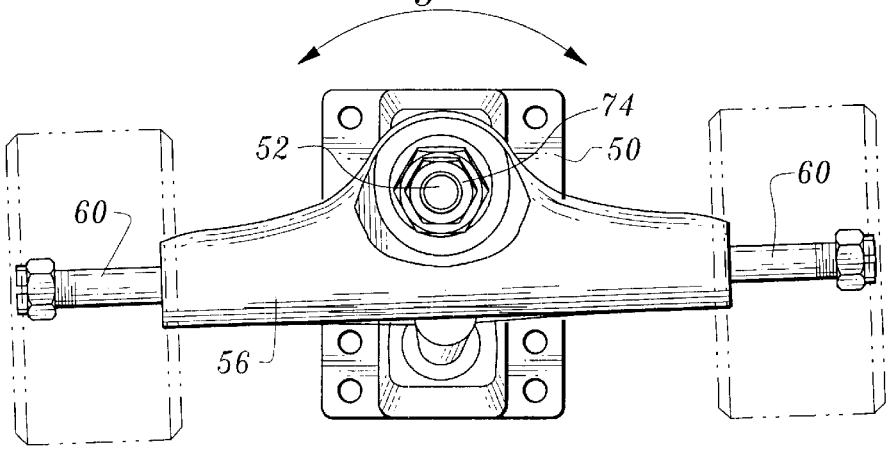
Figure 9:
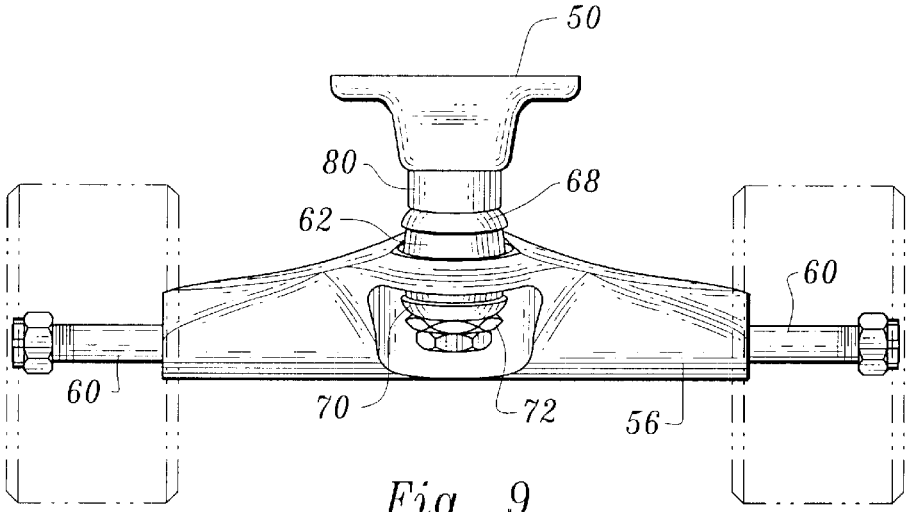
FIGS. 9 and 10 are elevational views of the truck assembly, wheels being shown in phantom, with FIG. 10 illustrating tilting of the wheel axles and related structure as typically occurs during skateboard use.
Figure 10:
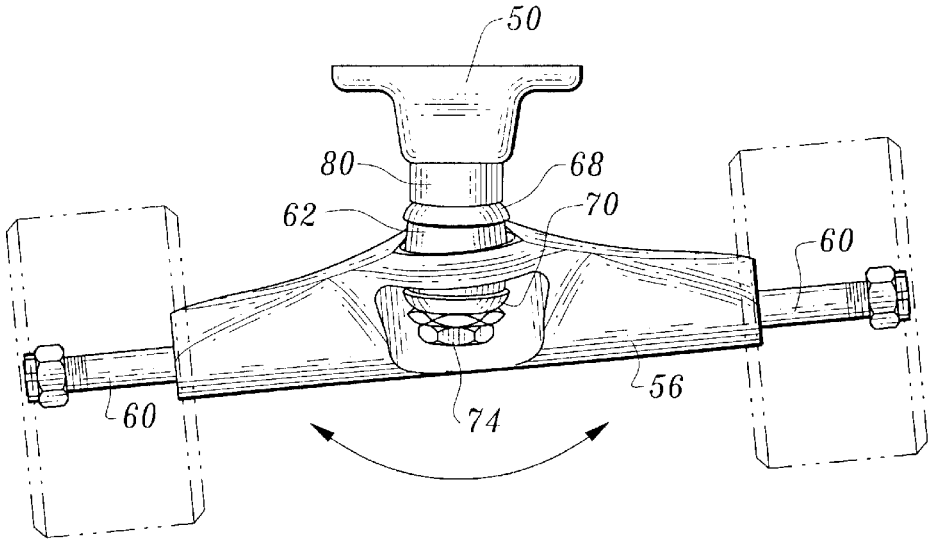

FIGS. 1 and 2 illustrate a typical prior art skateboard truck assembly having minimal shock absorbing capability. The assembly includes an assembly base 10 for attachment to the underside of a skateboard by screws or the like. A king pin 12 projects from the assembly base and has a threaded distal end 14.

An axle support member 16 defines an axle support member opening 18, the king pin 12 projecting through the axle support member opening. Resilient pads, bushings or cushions 20, 22 encircle the king pin. The resilient pads are spaced from one another and disposed on opposed sides of the axle support member. Located above pad 20 and in engagement therewith is a cup-shaped washer 24 encircling the king pin and disposed between the assembly base 10 and pad 20. A similarly shaped washer 26 is aid disposed under resilient pad 22. A king pin nut 28 is threadedly engaged with the threaded end of king pin 12 and is in engagement with washer 26. Tightening or loosening of the king pin nut will respectively increase or decrease compressive forces applied to the resilient pads to modify the steering capabilities of the skateboard to which the assembly is connected. It will be appreciated that an increase in those compressive forces applied to the resilient pads will lessen even more what little shock absorber function the pads provide.

Axle support member 16 includes an axle support member arm 30 having a distal end 32. Distal end 32 is positioned in a bearing element 34 disposed in a recess of the assembly base. The bearing element 34 is relatively hard but permits some movement of the distal end relative to the assembly base during use of the skateboard, the bearing element also possibly providing a minimal degree of shock absorbency.

Referring now to FIGS. 3–10, a shock absorbing skateboard truck assembly constructed in accordance with the teachings of the present invention has several structural components of the type utilized in the prior art device shown in FIGS. 1 and 2. The shock absorbing skateboard truck assembly includes an assembly base 50 for attachment to the underside of a skateboard and a king pin 52 projecting from the assembly base and having a threaded distal end 54. An axle support member 56 defines an axle support member opening 58, the king pin 52 projecting through the axle support member opening. Axles 60 project from the ends of axle support member 56, upon which are mounted the skateboard wheels.

Resilient pads 62, 64 encircle the king pin, the resilient pads being spaced from one another and disposed at opposed sides of the axle support member.

Pad retention means retains the first and second resilient pads in position relative to the axle support member. More particularly, a double-ended, elongated, threaded bushing 66 extends around the king pin and is disposed within the resilient pads 62,64. The bushing is axially slidably movable relative to the king pin. A flange 68 comprising part of the pad retention means is affixed to and radially extends outwardly from one of the ends of the bushing, the flange adjoining resilient pad 62. The flange 68 defines a recess for receiving resilient pad 62 to secure it in place.

The pad retention means also includes a retention member 70 under resilient pad 64. Retention member 70 is cup-shaped, having an opening therein. The retention member 70 is disposed about the threaded end of the bushing and defines a recess for receiving the resilient pad 64. A bushing nut 72 is threadedly engaged with the threaded end of the bushing. A king pin nut 74 is threadedly engaged with the king pin at the threaded distal end of the king pin. The bushing nut and the king pin nut are adjacent to one another and coaxial.

Positioned between flange 68 and assembly base 50 is a resilient shock absorber member 80 formed of elastomeric material, rubber or the like. The resilient shock absorber member is annular-shaped and defines a hole receiving the king pin. In the arrangement illustrated, a washer 82 formed of plastic or the like extends about the king pin and is positioned between the upper end of the bushing and the resilient shock absorber member.

The king pin has a groove 84 comprising an O-ring seat about the outer periphery thereof. An O-ring 86 is located in the groove and projects outwardly from the king pin into engagement with the bushing 66. When washer 82 is under compression a portion thereof is located between the king pin and the bushing. Thus, the washer 82 and the O-ring 86 serve to reduce or even eliminate direct frictional engagement between the bushing and the king pin. As stated above, the busing is slidable relative to the king pin. Rotation of king pin nut 74 will result in adjustment of the suspension stiffness by changing the compressive forces applied to shock absorber member 80. On the other hand, rotation of bushing nut 72 is threaded engagement with bushing 66 will vary the compressive forces applied to resilient pads 62, 64, thereby providing for steering adjustment.

Axle support member 56 includes an axle support member arm 90 having a distal end 92. This distal end fits in a shock absorbing element 94 located in assembly base recess 96, as perhaps best may be seen in FIG. 4. The shock absorbing element 94 is preferably made of elastomeric material and also is preferably friction fit or otherwise releasably secured in recess 96 so that shock absorbing elements of different hardness can be substituted for one another, depending upon whether or not a smoother or firmer ride is desired. The same is true for the shock absorber member 80. A rider can select a shock absorber member providing either a greater or lesser degree of hardness depending upon whether a firmer or smoother ride is desired.

Figure 11:
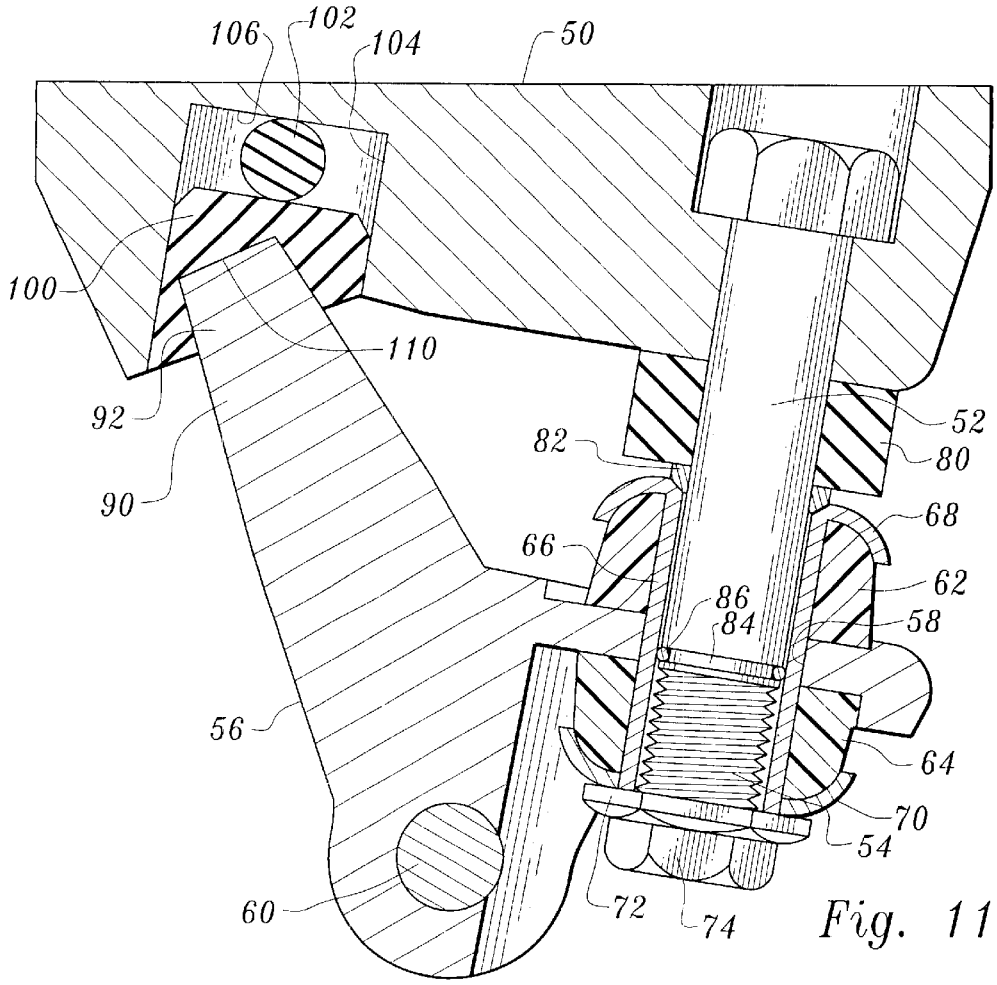
FIG. 11 is a view similar to FIG. 4 but illustrating an alternative embodiment of the invention.
Figure 12:
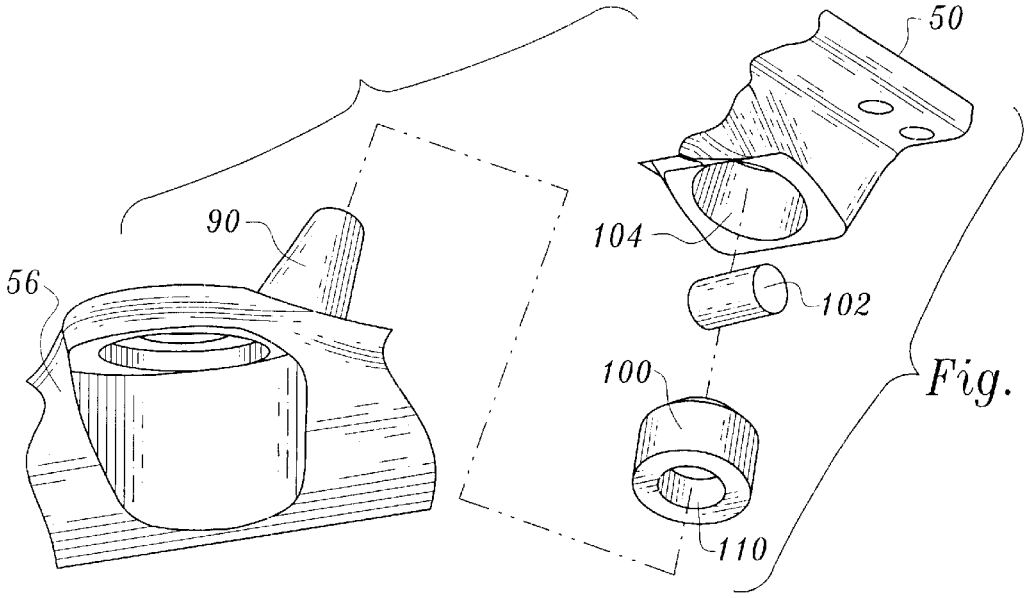
FIG. 12 is an exploded, perspective view illustrating components of the alternative embodiment prior to assembly thereof.

Referring now to FIGS. 11 and 12, an alternative embodiment of the invention is illustrated. In this embodiment a shock absorber consisting of a non-resilient, non-flexible shock absorber element 100 and a resilient, flexible shock absorber element 102 is positioned in a recess 104 of assembly base 50. At the bottom thereof shock absorber element 102 is engaged by shock absorber element 100, and at the top thereof by an abutment surface 106 of the assembly base. The resilient, flexible shock absorber element 102 is suitably formed of elastomeric material. In the illustrated embodiment, element 102 is cylindrically-shaped, however other shapes are possible. It is preferred that the element 102 not occupy all the recess space between the non-resilient, non-flexible shock absorber element 100 and abutment surface 106 so that the element 102 is free to expand outwardly when compressed during use.

The non-resilient, non-flexible shock absorber element 100 may be formed of any suitable hard, rigid material such as hard, rigid plastic material. The element 100 is slidably disposed in the recess so that it can move in a lineal path of movement defined by the recess. It has been found that canting of the recess as shown so that the lineal path of movement of the element 100 is parallel to the longitudinal axis of king pin 52 contributes to the stability of the truck and improves the overall steering capabilities of the skateboard or skate in which the truck is incorporated. Non-resilient, non-flexible shock absorber element 100 defines a depression 110 at the bottom thereof receiving the distal end 92 to stabilize the interconnection between these two components.

Use of both a non-resilient, non-flexible shock absorber element and a flexible, resilient shock absorber element provides for a desired degree of shock absorber resiliency while also limiting wear on the shock absorber due to contact with the axle support member arm distal end. It will be appreciated that a smoother or softer ride can be obtained by replacing the flexible, resilient shock absorber element 102 with one of greater or lesser flexibility and resiliency. The size and shape of element 102 can also be varied.

The invention claimed is:

1. A shock absorbing skate truck assembly comprising, in combination:

an assembly base defining an assembly base recess;

a king pin projecting from said assembly base and spaced from said assembly base recess, said king pin having a threaded distal end;

an axle support member defining an axle support member opening, said king pin projecting through said axle support member opening, said axle support member movable relative to said king pin, and said axle support member including an axle support member arm having a distal end located at said assembly base recess;

a first shock absorber positioned between said axle support member and said assembly base at said king pin; and a second shock absorber located in said assembly base recess engageable by the distal end of said axle support member arm, said assembly base recess terminating at an assembly base abutment surface on said assembly base, said second shock absorber comprising a flexible, resilient shock absorber element located in said recess in engagement with said assembly base abutment surface and a substantially non-flexible, non-resilient shock absorber element located in said recess in engagement with said flexible, resilient shock absorber element, said substantially non-flexible, non-resilient shock absorber element engageable by the distal end of said axle support arm and located between the distal end of said axle support arm and said flexible, resilient shock absorber element, said substantially non-flexible, non-resilient shock absorber element slidably disposed in the recess, with said recess defining a substantially lineal path of movement for said substantially non-flexible, non-resilient shock absorber element, said flexible, resilient shock absorber element being located below said assembly base abutment surface and above said substantially non-flexible, non-resilient shock absorber element and being compressed between said assembly base abutment surface and said substantially non-flexible, non-resilient shock absorber element when said substantially nonflexible, non-resilient shock absorber element moves along said substantially lineal path of movement toward said assembly base abutment surface.

2. The shock absorbing skate truck assembly according to claim 1 wherein said substantially non-flexible, non-resilient shock absorber element defines a depression receiving the distal end of said axle support arm.

3. The shock absorbing skate truck assembly according to claim 1 wherein said king pin has a longitudinal axis, said substantially lineal path of movement being substantially parallel to the orientation of the longitudinal axis of said king pin.

* * * * *